US005095658A

United States Patent [19]

Anderhalden

[11] Patent Number: 5,095,658

[45] Date of Patent: Mar. 17, 1992

[54] WEATHER-STRIP SEALS AND INSTALLATION THEREOF

[76] Inventor: Arnold Anderhalden, 9012 Gullo Ave., Arleta, County of Los Angeles, Calif. 91332

[21] Appl. No.: 635,657

[22] Filed: Dec. 27, 1990

[51] Int. Cl.[5] ..... E06B 7/16

[52] U.S. Cl. ..... 49/489; 49/479; 49/492; 49/498

[58] Field of Search ..... 49/489, 479, 485, 475, 49/498, 492

[56] References Cited

U.S. PATENT DOCUMENTS

| | | | |
|---|---|---|---|
| 1,998,791 | 4/1935 | Schanz | 49/489 |
| 2,819,065 | 1/1958 | Jones | 49/489 X |
| 3,140,517 | 7/1964 | Richter | 49/489 |
| 3,448,543 | 6/1969 | Multer | 49/489 X |
| 4,658,548 | 4/1987 | Gerritsen | 49/489 X |

FOREIGN PATENT DOCUMENTS

| | | | |
|---|---|---|---|
| 1112246 | 3/1956 | France | 49/489 |
| 2112436 | 7/1983 | United Kingdom | 49/489 |

*Primary Examiner*—Philip C. Kannan
*Attorney, Agent, or Firm*—William H. Maxwell

[57] ABSTRACT

A weather proofing seal for installation in complementary eliptically undercut channels in a door or window jamb, characterized by a dart-shaped anchor having a rib projecting through a narrow slot opening of the channel, the seal characterized by a depressible bulb-shaped body lying contiguous to both the jamb and a slamming stop.

7 Claims, 1 Drawing Sheet

WEATHER-STRIP SEALS AND INSTALLATION THEREOF

BACKGROUND OF THE INVENTION

This invention relates to weather seals or stripping for door and window openings as they are constructed in buildings and the like. Conventional door and window jambs vary in type, there being casement doors and windows, double hung windows, and sliding doors and windows etc. It is wooden door and window jambs with which this invention is particularly concerned, those that can be routed for the reception of a continuous seal installed to be effective between the jamb and the moveable door or window, it being a general object of this invention to provide a weather strip seal installation in existing as well as new construction. This invention is characterized by a routed channel and a seal configuration adapted to wooden jambs, headers or sills, whether new or old. However, it is an object of this invention to provide a seal equally useful for metal construction.

Door and window openings are constructed of a frame comprised of spaced jambs extending upward from a sill and joined at the top by a lintel or header. In casement doors and windows there is a door stop or slamming stop, which is a strip or projecting surface against which the door or window closes. And, it is this stop with which this invention is particularly concerned, since the stops of the header and sill join at right angular corners with the stops on the jambs, and heretofore it has been difficult if not impossible to rout into such corners for the installation of a continuous weather strip seal. The face of the stop is right angularly related to the face of the jamb, and it is an object of this invention to rout a seal groove disposed in a plane to bisect the right angularly related planes of said two faces. Accordingly, a routing tool is provided in accordance with my copending application Ser. No. 07/438,191, filed Nov. 20, 1989 and now issued as U.S. Pat. No. 4,993,897, with a guide that simultaneously follows the faces of the stop and jamb or header, and also provided with means to advance and to retract a specially shaped cutter into and out of working position that continuously routs an elliptically undercut groove at a compound angle into and bisecting the corner established by said two faces.

Heretofore, seal strips with dart-shaped anchors have been installed under the aforementioned stop and jamb condition, by routing dovetail grooves receiving a seal anchor of complementary shape. However, these seals have not been entirely secure. With the present invention a discrete compound angle of the cutter is advantageously utilized and coordinated with the barrel length of the cutter to create an adequate shoulder at each side of an elliptically undercut groove of dart-shape configuration. The opposite anchor shoulders are a developement of the inclined cutter's flutes that converge to a point so as to cut a dart-shaped groove (see FIG. 3).

It is an object of this invention to provide a continuous weather strip seal which is versatile and adapted to different door and window situations. That is, the moveable doors and windows may or may not be installed or removed, some are of the casement type while others are of the sliding type, and the construction to be improved with seals might be old or new.

It is also an object of this invention to provide for angular advancement of the routed channel into and continuously through the corners established by the right angularly related jambs, headers and sills. A feature of this seal is its reliable securement and continuation through continuing angularly related corner channels.

SUMMARY OF THE INVENTION

This invention makes possible the continuity of weather strip seals securely installed in door and window frames, for engagement with moveable doors and windows. The superior anchoring capability of a dart-shaped undercut is routed into new or existing building structure, by a tool provided therefor in conjunction with a complementary cutter. The tool features an angular disposition of the router axis, and the cutter is advanced into the work through hand-grip force, and the cutter position is controlled by an associated guide engagable with and to follow the jamb face and its slamming stop. Compound angularity of the router axis with respect to the planar surface or surfaces to be routed is discretely selected, by which the oval cut by the major diameter of the cutter forms a shoulder disposed at a right angle to the apex of the dart-shaped groove routed thereby. The seal is an extrusion of silicon plastic material, or the like, that is supple and depressible, and with memory to return to its original deformable tube shape. This deformable tube is held in position tangent to the planes of the jambs or header or sill, and tangent to the planes or the slamming stop, where it is depressed by the closing of the door or window, as the case may be. The dart-shaped anchor is integral with the deformable tube and projects therefrom in a plane radial to the axis of the tube, to enter and occupy the routed groove. Accordingly, the seal extends into and turns through each corner without being severed. However, seal sections may join at the corners into which they extend.

The foregoing and various other objects and features of this invention will be apparent and fully understood from the following detailed description of the typical preferred forms and applications thereof, throughout which description reference is made to the accompanying drawings.

THE DRAWINGS

PREFERRED EMBODIMENT

Figure 1:
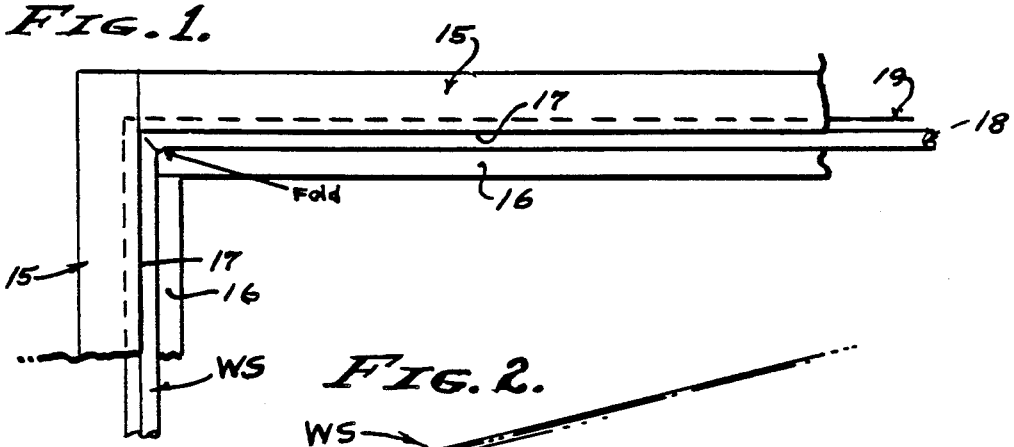
FIG. 1 is a view of a door or window jamb, showing the weather strip installed through a corner formed by two jambs.

Referring now to the drawings, it is the angular faces of jambs which are of concern, namely the right angular jamb and slamming or sliding stop faces, and also the right angular jambs and sill and headers. This invention is concerned primarily with wood working machines known generally as routers, with a cutter C secured in a collet to project along the turning axis a of the router in order to enter a work piece, in this instance to enter the jamb and/or to penetrate into the aforementioned corners. It is to be understood that the weather seal WS is applicable to various jambs or like situations, a feature being the continuity of the seal and its complementary undercut channel.

Figure 2:
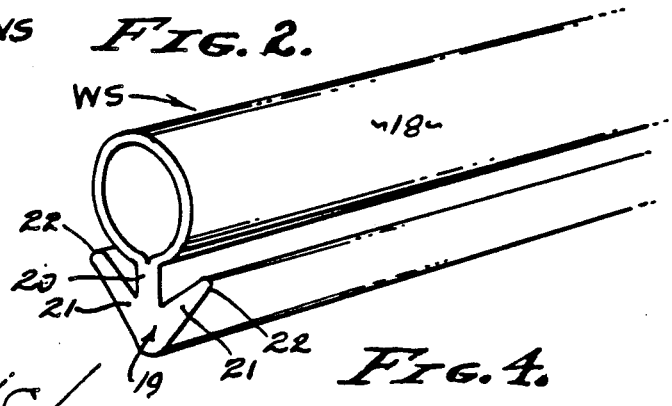
FIG. 2 is an enlarged perspective view of the flexible and depressible weather strip seal.
Figure 3:
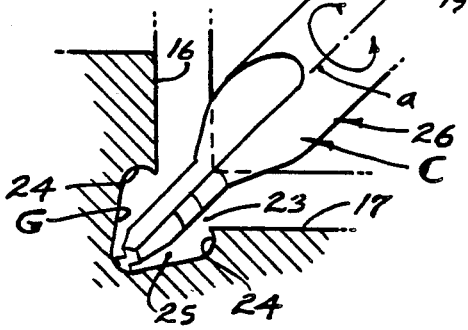
FIG. 3 is an enlarged fragmentary sectional view showing a cutter in the process of cutting the groove or rabbet.
Figure 4:
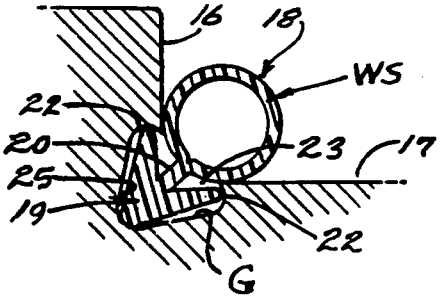
FIG. 4 is a view similar to FIG. 3 showing the weather strip seal installed in the groove.
Figure 5:
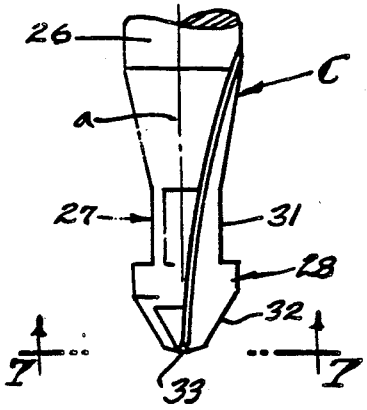
FIG. 5 is a side view of a cutter having the features of the present invention.
Figure 6:
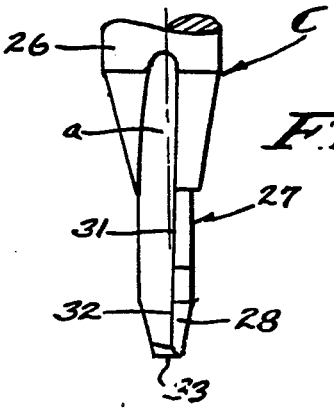
FIG. 6 is a side view of the cutter shown in FIG. 5.

Typical jamb members 15 are shown in FIG. 1 of the drawings, and the step or slamming stop 16 is typically at a right angle to the face 17 thereof. FIG. 3 illustrates the manner in which the cutter C is worked in relation to the stop 16 and face 17, FIG. 4 showing the way the seal groove G receives the weather strip WS. The weather strip WS is shown in its elongated form in FIG. 2, being an elongated body extruded of silicon plastic or the like that is soft and pliable, and depressible for seal engagement with a door or window that is closed thereagainst.

The weather strip WS is comprised of a depressible body 18 and a dart-shaped anchor 19, integrally formed as a tubular extrusion or the like and joined by a rib 20. In practice, the body 18 is tubular with a thin and flexible cylindrical wall, the rib 20 projects radially from the body wall and carries a pair of rearwardly divergent flanges 21, diverging at approximately 60°, and terminating in continuous parallel edges 22 spaced equally from opposite sides of the rib 20 in a plane at or slightly below the body 18. There are variations or this weather seal WS configuration, as circumstances require. The anchor flanges 21 are depressible so as to be readily forced into working position within the confines of the seal grooves G next described.

The seal groove G is the configuration that is cut into the work piece or jamb member 15, and it is of a form complementary to that of the dart-shaped anchor 19. A feature of this groove and seal arrangement is that the depressible body 18 of the weather strip WS lies contiguous to both the face or faces of the jamb member and of the slamming stop (See FIG. 4). Also, the rib 20 of the weather strip WS enters through a continuous slot 23 or the groove G while the anchor flanges 21 are captured within the undercut rails 24 of the groove G (see FIG. 3). Accordingly, the groove G is characterized by spaced parallel rails 24 that form the slot 23, and by an underlying channel 25 of dart-shaped configuration that permits spreading of the weather strip flanges 21 into engagement beneath the rails 24, thereby capturing the weather strip WS in working position with the body 18 thereof exposed for compression by the closing of a window or door.

The cutter C is provided to form the above described seal groove G, and it is rotated at high speed by a router (not shown) on an axis a that is coincidental with a bilateral 45° plane of symetry of said groove G, as it bisects the jamb face 17 and slamming stop 16. The cutter C is guided so as to move forwardly and rearwardly with the axis a held in said 45° plane of symetry. A feature is the compound angular disposition of the cutter axis a to the bisecting angle, or 45° between the jamb face and slamming stop (see FIG. 3). In practice, the compound angular disposition is 60° (not shown) whereby the cutter C can be advanced to enter the corners which are otherwise inaccessible to the cutter. FIG. 1 shows continuity of the seal groove G through the corner, where the seal WS is folded.

The cutter C is comprised of a shank 26, a stem 27 that cuts the slot 23, and a head 28 that cuts the channel 25. The shank 26 is an elongated cylindrical solid that carries the stem and head, the latter being of high speed material such as carbide. The shank is of a diameter of for example 0.250 inch, substantially the same as the major diameter of the head 28, and it tapers to the stem for chip clearance. The cutter is of "spade" form as shown, the stem 27 and head 28 extending integrally as a flattened member having diametrically opposite cutting edges. The stem 27 and head 28 are flattened so as to have cutting faces establishing diametrically opposite cutting edges at the periphery of the cutter.

Figure 7:
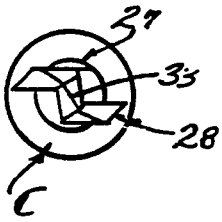
FIG. 7 is an end view of the cutter and taken as indicated by line 7—7 on FIG. 5.

Referring now to FIG. 7 of the drawings, the stem 27 has a reduced cutting diameter of for example 0.150 inch for a substantial axial length of for example 0.120 inch, the periphery at each cutting edge 31 being relieved for clearance when cutting the slot 23. The head 28 is full diameter of for example 0.225 inch, for a limited axial length of for example 0.050 inch, this being for durability in undercutting the rails 24 (see FIG. 3). The head 28 is convergent so as to cut a dart-shaped channel 25, and to this end its diametrically opposite cutting edges 32 are symetrically convergent from the aforementioned full diameter, and to a point 33 and preferably a blunted point for cutting a rounded bottom of the channel 25, as a result of the compound inclined axis of the cutter.

According to the above, the straight parallel cutting edges of the stem 27 cut straight parallel slot edges, while the full diameter and reduced point diameters of the head 28 cut an eliptical cross section, as shown. Note however, that the eliptical undercut of rails 24 form shoulders disposed substantially normal (90°) to the bottom center of the channel 25, thereby ensuring reliable anchored engagement with the edges 22 of the weather strip flanges 21.

From the foregoing it will be understood how a special cutter forms a continuous seal groove for anchored reception of the weather-strip seal. A feature is the eliptical form of the groove channel that captures the seal as it is folded so as to continue through the corner connection of the channel grooves.

Having described only the typical preferred forms and applications of my invention, I do not wish to be limited or restricted to the specific details herein set forth, but wish to reserve to myself any modifications or variations that may appear to those skilled in the art as set forth within the limits of the following claims.

I claim:

1. In combination, an undercut seal groove of symetrical configuration bisecting a jamb face and a slamming stop face and undercut with complementary spaced and inwardly faced parallel rails at the jamb face and slamming stop, and an elongated dart-shaped weather-strip seal comprised of an anchor portion inserted into said undercut groove and having depressible parallel and opposite side edges engaged with the complementary undercut rails of the undercut groove in the jamb face and slamming stop, and a depressible bulb portion having angularly related peripheries having sealed engagement with said jamb face and said slamming stop, there being a rib portion joining the anchor portion and the bulb portion.

2. The combination of the undercut seal groove and weather-strip seal as set forth in claim 1, wherein the elongated dart-shaped weather-strip seal is an extrusion of silicon plastic.

3. The combination of the undercut seal groove and weather-strip seal as set forth in claim 1, wherein the bulb portion is of tubular cross section.

4. The combination of the undercut seal groove and weather-strip seal as set forth in claim 1, wherein the elongated dart-shaped weather-strip seal is an extrusion of silicon plastic, and wherein the bulb portion is of tubular cross section.

5. The combination of the undercut seal groove and weather-strip seal as set forth in claim 1, wherein the anchor portion is of dart-shaped cross section.

6. The combination of the undercut seal groove and weather-strip seal as set forth in claim 1, wherein the anchor portion is of dart-shaped cross section comprised of divergent opposite side flanges forming said opposite side edges.

7. The combination of the undercut seal groove and weather-strip seal as set forth in claim 1, wherein the anchor portion is of dart-shaped cross section comprised of side flanges divergent from a vertex and forming said opposite side edges.

* * * * *